US010343836B2

(12) United States Patent
Li

(10) Patent No.: US 10,343,836 B2
(45) Date of Patent: Jul. 9, 2019

(54) DISPENSING CONTAINER

(71) Applicant: GUMFRIEND INTERNATIONAL CORPORATION, Wilmington, DE (US)

(72) Inventor: Yang Li, Mississauga (CA)

(73) Assignee: Gumfriend International Corporation, Wilmington, DE (US)

( * ) Notice: Subject to any disclaimer, the term of this patent is extended or adjusted under 35 U.S.C. 154(b) by 0 days.

(21) Appl. No.: 16/121,585

(22) Filed: Sep. 4, 2018

(65) Prior Publication Data

US 2019/0092557 A1 Mar. 28, 2019

Related U.S. Application Data

(60) Provisional application No. 62/562,079, filed on Sep. 22, 2017.

(51) Int. Cl.
*B65D 83/04* (2006.01)

(52) U.S. Cl.
CPC ..... *B65D 83/04* (2013.01)

(58) Field of Classification Search
CPC ..... B65D 83/04; B65D 83/0409
USPC ..... 221/277, 79, 87, 263, 241, 304, 207, 44
See application file for complete search history.

(56) References Cited

U.S. PATENT DOCUMENTS 2,039,282 A 5/1936 Burke
2,341,447 A 2/1944 Klotz
2,669,349 A 2/1954 Silver
3,301,437 A 1/1967 Faber
3,310,201 A 3/1967 Guarr et al.
3,319,827 A 5/1967 Englesson
3,362,583 A 1/1968 Showalter
3,610,466 A 10/1971 Raybois
3,788,517 A 1/1974 Eannarino et al.
3,828,972 A 8/1974 Bender
4,557,690 A 12/1985 Randin
4,561,544 A 12/1985 Reeve
5,174,471 A 12/1992 Kozlowski et al.
5,205,424 A 4/1993 Gaspar
5,482,183 A 1/1996 Beal et al.
5,553,739 A 9/1996 Plum et al.
(Continued)

FOREIGN PATENT DOCUMENTS

CN 201381059 1/2010
CN 102398736 4/2012
(Continued)

OTHER PUBLICATIONS

International Search Report and Written Opinion in corresponding International PCT Application No. PCT/US2018/049420, dated Dec. 31, 2018 in 21 pages.
(Continued)

*Primary Examiner* — Jacob S. Scott
*Assistant Examiner* — Ayodeji T Ojofeitimi
(74) *Attorney, Agent, or Firm* — Knobbe Martens Olson & Bear LLP

(57) ABSTRACT

A dispenser apparatus may include a housing and a delivering structure at least partially enclosed by the housing. The dispenser apparatus may dispense desired sizes or pieces of tablets, pills candy, mints, chewing gum or the like. The dispenser apparatus is refillable when a cover or lid is open.

28 Claims, 11 Drawing Sheets

(56) References Cited

U.S. PATENT DOCUMENTS

| | | | | |
|---|---|---|---|---|
| 6,398,072 | B1 * | 6/2002 | Nitta | A47F 1/085 221/303 |
| 6,543,639 | B1 * | 4/2003 | Kovens | B65D 83/0418 221/217 |
| 6,763,971 | B1 | 7/2004 | Tong | |
| 6,976,576 | B2 | 12/2005 | Intini | |
| 7,360,669 | B2 | 4/2008 | Drajan | |
| 2003/0159965 | A1 | 8/2003 | Baker et al. | |
| 2004/0124204 | A1 | 7/2004 | Giraud | |
| 2005/0205598 | A1 | 9/2005 | Gelardi | |
| 2007/0000938 | A1 | 1/2007 | Renaud | |
| 2007/0114239 | A1 | 5/2007 | Smith et al. | |
| 2008/0011773 | A1 | 1/2008 | Tobias | |
| 2008/0230554 | A1 | 9/2008 | Randolph | |
| 2012/0138503 | A1 * | 6/2012 | Patel | B65D 1/0215 206/524.7 |
| 2013/0008918 | A1 | 1/2013 | Cronin | |
| 2016/0130071 | A1 * | 5/2016 | Li | B65D 83/0409 221/174 |

FOREIGN PATENT DOCUMENTS

| | | |
|---|---|---|
| CN | 102530406 | 7/2012 |
| CN | 202295841 | 7/2012 |
| FR | 2928356 | 9/2009 |

OTHER PUBLICATIONS

International Search Report issued in related International Application No. PCT/CN2012/080892, dated Mar. 28, 2013, 3 pages.

* cited by examiner

DISPENSING CONTAINER

TECHNICAL FIELD

The present disclosure relates generally to a dispenser apparatus, and more particularly, to a dispenser apparatus which is able to dispense desired sizes or pieces of tablets or pills.

BACKGROUND

Many people daily require or consume tablets, pills, mints, candies, or the like. Existing dispenser apparatuses are not convenient to dispense these objects and may present difficulties in such dispensing. For example, people sometimes want to consume a smaller sized candy. At other times, they may desire a larger sized object such as chewing gum. Additionally, there are times when precise dispensing may be required, such as when dispensing pills, and other times when dispensing can be less precise, such as when a user is dispensing candy. Existing dispenser apparatuses are not well-suited to fulfill these requirements. Moreover, many existing dispensers are not designed to be reusable, contributing to waste. Accordingly, there is a need for a dispenser apparatus that addresses one or more of the abovementioned deficiencies.

BRIEF DESCRIPTION OF THE DRAWINGS

To complete understand the present disclosure and features and advantages thereof, referencing the provided following description when read in conjunction with the companying figures, background, technical field of the disclosure, and headings. In the present disclosure and different figures, the identical numerals and/or letters may be repeated should be considered as the same element or a functionally equivalent element.

DETAILED DESCRIPTION

Figure 1:
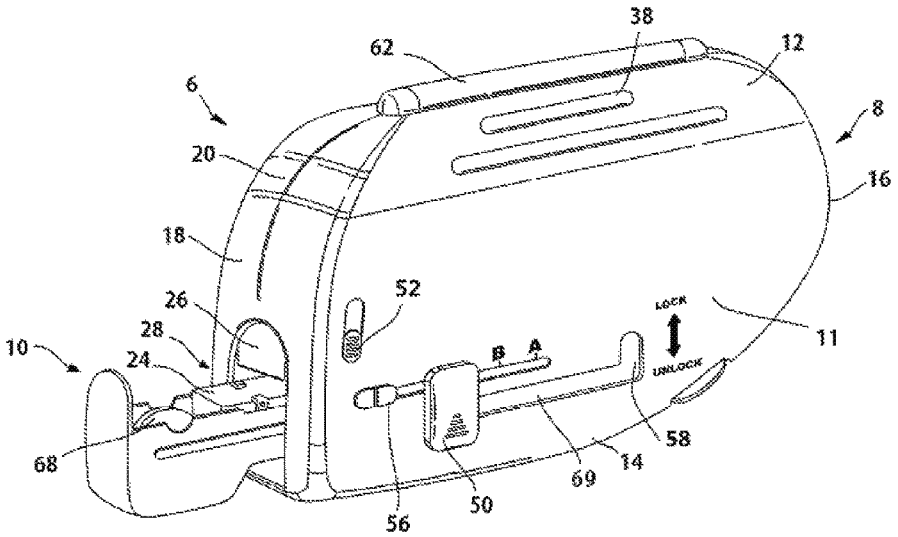
FIG. 1 is a perspective view illustrating an aspect of a dispenser apparatus in a dispensing configuration.

It is to be understood that the present disclosure is not limited to the details of the description, and various other modifications and applications can be considered. Further changes of the device, design, configuration or methods will be made to those skilled in the art without deviating from the true spirit of the scope of the disclosure herein described, therefore, the detail of description in the disclosure should be interpreted as illustration not to limit the scope of the invention. Additionally, it would be recognized that the present disclosure is not limited to a particular kind or shape of tablets or pills and it is to be understood that throughout the specification and claims the term "tablets or pills" is used to include capsules, chewing gum, mint, candy or various small piece of confections or any other objects which may be dispensed from the apparatus.

In one aspect of the present disclosure, a dispenser apparatus may include a delivering structure and a housing. In a first, stowed configuration, the delivering structure may be situated in the housing, whereas in a second, dispensing configuration, a carrying holder of the delivering structure is moved out of the housing for dispensing tablets or pills. A holder exit is disposed on the housing, and the delivering structure may be reciprocate between the stowed configuration and the dispensing configuration through the holder exit.

A baffle apparatus of the delivering structure and/or a barrier apparatus defined between two sides of the dispenser apparatus may divide the housing into an upper chamber and a lower chamber. The upper chamber may be used as a storage chamber to storage the tablets or pills, and the delivering structure may be situated in the lower chamber when in the stowed configuration.

The holder baffle apparatus may direct the tablets or pills from the storage chamber into the carrying holder of the delivering structure.

Several transverse or obliquely vertical or slope bodies may be configured on at least one side of the housing to form a funnel apparatus between the storage chamber and the carrying holder of the delivering structure so as to facilitate rolling or other movement of the tablets or pills from the storage chamber into the carrying holder fluently or in alignment in the stowed configuration.

At least one side of the dispenser apparatus may be curved to form the funnel apparatus between the storage chamber and the carrying holder of the delivering structure so as to facilitate transfer of the tablets or pills from the storage chamber into the carrying holder fluently or in alignment in the stowed configuration.

An adjusting plate may be disposed on the holder exit of the housing, and a button may engage the adjusting plate to change the dimension of the holder exit. Another adjusting plate may be disposed on a barrier apparatus to change the dimension of an opening defined between the holder exit of the housing and the barrier apparatus.

An adjusting apparatus may be configured on the delivering structure to change the dimension of the carrying holder.

A button connected to the delivering structure has a detent or other means to prevent the delivering structure from unintended movement in the stowed configuration.

Additionally, it is within the teachings of the present disclosure that the dispenser apparatus may be formed from any suitable material, such as but not limited to plastic, synthetic, metal, rubber, natural or any other suitable materials, and the dispenser apparatus may be transparent or opaque.

FIG. 1 illustrates the dispenser apparatus 6 in a dispensing configuration. The dispenser apparatus 6 may include a delivering structure 10 and a housing 8 at least partially enclosing the delivering structure 10. It should be understood by those of skill in the disclosure that the housing 8 may be formed by single or multiple elements separately or integrally formed. For example, the housing 8 may have a front cover 11 and a back cover 9, a top 12 and a bottom 14, a right end wall 16 and a left end wall 18. A corner 20 between the left end wall 18 and the top 12 may be rounded, cut or the like, etc., which may prevent the dispenser apparatus 6 from colliding with a user's mouth when the user retrieves tablets or pills from the dispenser apparatus 6. One or more of the front cover 11 and back cover 9, the top 12 and the bottom 14, the right end wall 16 and left end wall 18 may be curved in order to enlarge the dispenser inside capacity or facilitate comfort for a user. In alternative aspects, the housing 8 may have other suitable configurations that permit the functionality described herein. For example, the housing 8 may be configured as a cube, sphere, cylinder, etc. Additionally or alternatively, the housing may be configured in the shape of an animal, cartoon character, etc., which may attract the attention of a child or other user.

As shown in FIG. 1, a holder exit 28 is configured on the left wall 18 adjacent the bottom 14. The delivering structure 10 may be configured for reciprocating motion between a stowed configuration (see FIG. 2) and the dispensing configuration through the holder exit 28. Additionally, a push button 50 may be formed with or otherwise operatively coupled to the delivering structure 10, such that a user may push the button 50 forward to engage the delivering structure 10 to move it from the stowed configuration to the dispensing configuration. The delivering structure 10 may engage a spring 74 (see FIG. 6A) to provide a biasing force that acts to automatically return the delivering structure 10 to the stowed configuration upon removal of the user's force. In one aspect, an adjusting plate 26 may be disposed proximate the holder exit 28, and a push button 52 may engage the adjusting plate 26 to move the plate 26 up or down for changing the dimension of the holder exit 28, e.g., to prevent extraneous tablets or pills 68 from rolling out of the holder exit 28 when a user operates the apparatus 6.

To enhance a user's grip, ridges or stripes 38 may be configured on the top 12 of the housing 8. The ridges 38 may be formed as an over-molded element having a softer or lower durometer hardness than the housing 8, and it is to be understood that the ridges 38 may have any configuration that provides the intended functionality. For example, the ridges 38 may be sinusoidal, may be comprised of a plurality of touching linear segments, etc.

Figure 2:
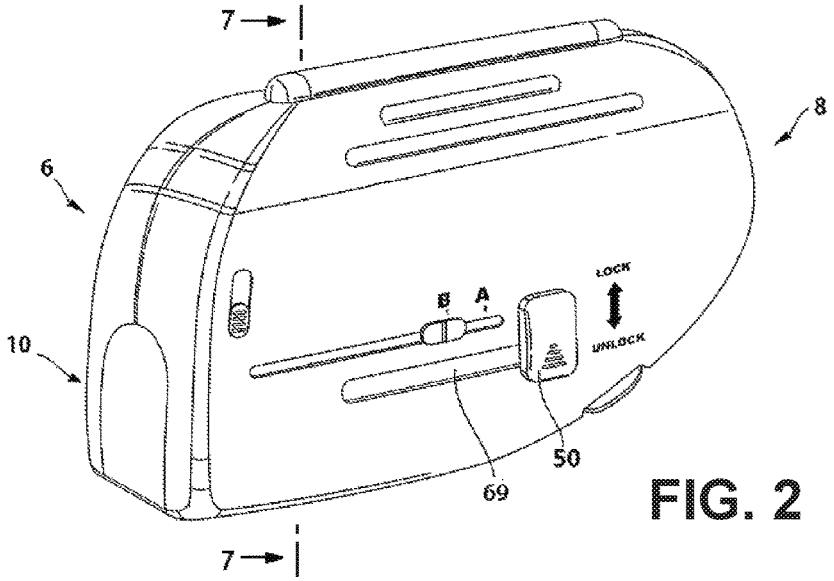
FIG. 2 is a perspective view illustrating the dispenser apparatus of FIG. 1 in a stowed configuration.

As shown in FIG. 2, the dispenser apparatus 6 is in a stowed configuration, with the delivering structure 10 positioned in the housing 8. The push button 50 and the groove 69 may have a detent or other means 58 (see FIG. 1) to prevent the delivering structure 10 from unintended movement when the dispenser apparatus is in the stowed configuration. The push button 50 may be pushed up along the detent means 58 to a lock position so that the delivering structure 10 cannot be engaged. When the delivering structure 10 is desired to be actuated, the push button 50 then may be pushed down to the unlock position, separating the push button 50 from the detent 58.

Figure 3A:
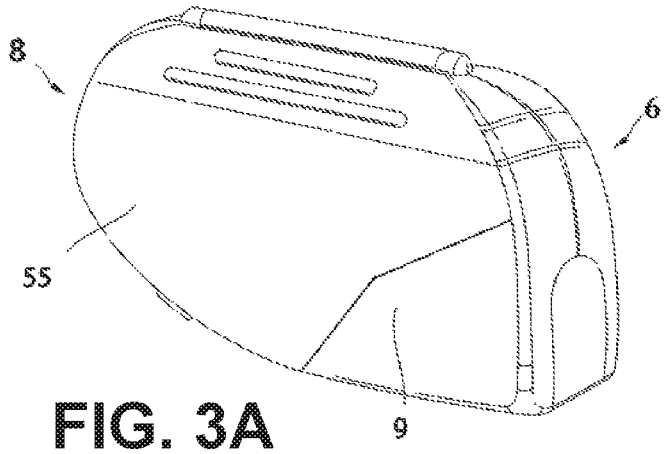
FIG. 3A is a perspective view illustrating the reverse side of the dispenser apparatus of FIG. 1 in the stowed configuration.
Figure 3B:
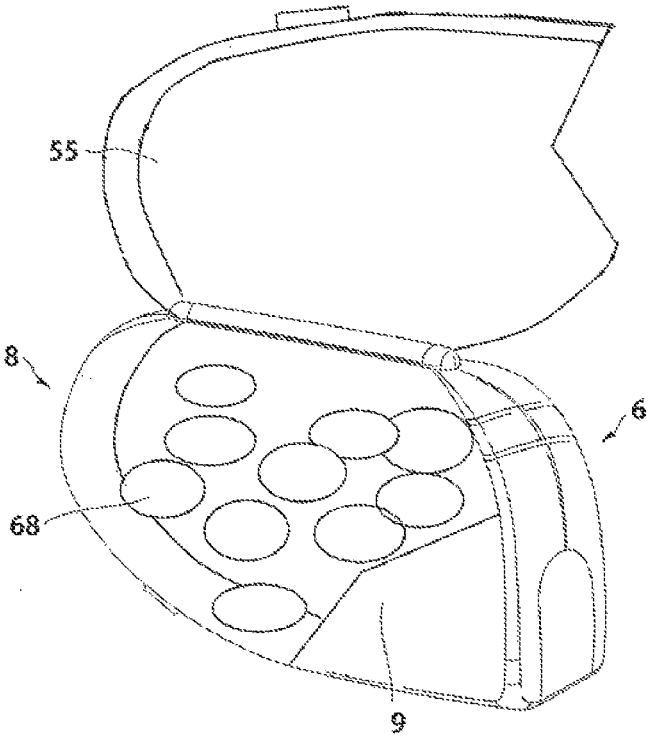
FIG. 3B is a perspective view illustrating the reverse side of the dispenser apparatus of FIG. 1 in the stowed configuration and with a lid open.

As shown in FIGS. 3A and 3B, the dispenser apparatus 6 may have a lid 55 disposed on the back cover 9 of the housing 8 and may be hinged on the top 12 of the housing 8. In FIG. 3A, the lid 55 is in a closed position. In FIG. 3B, the lid 55 is in an open position. Thus, a user may refill the tablets or pills 68 by opening the lid 55. The lid 55 may be made of the same material as the other parts of the dispenser apparatus 6. Additionally or alternatively, the lid 55 may be made of a material with transparency so that the user can see how many pieces of tablets or pills are in the dispenser apparatus 6. Further, the lid 55 may include material that can emit light or glow in the dark so that the dispenser apparatus 6 can be easily located during night or in a dark room.

As shown in FIG. 4, the housing 8 may have a first side and a second side that couple to one another to define the interior of the housing therein, and the delivering structure 10 may reciprocate between the two sides. In one aspect, the delivering structure 10 may include a carrying holder 30, a baffle apparatus 32, and an adjusting apparatus 24. The carrying holder 30 is used for holding and carrying the tablets or pills 68 and the rear of the carrying holder 30 may include or couple to the baffle apparatus 32. The adjusting apparatus 24 may be disposed on the delivering structure 10 to change the inside dimension of the carrying holder 30 so that the dispenser apparatus 6 may dispense various sizes or intended pieces of tablets or pills 68.

A piece of barrier apparatus 36 may extend between the first and second side, adjacent the end of baffle apparatus 32 in order to prevent the tablets and pills 68 from falling into the gap formed when the delivering structure 10 moves to the dispensing position. The barrier apparatus 36 may cooperate with the baffle apparatus 32 to divide the housing 8 into an upper chamber and a lower chamber. The upper chamber may be used as the storage chamber 55 to store the tablets or pills 68, and the delivering structure 10 may be situated in the lower chamber in the stowed configuration.

Figure 5A:
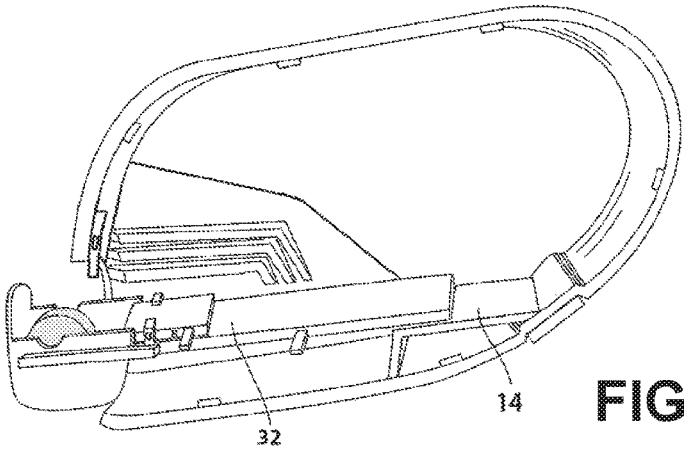
FIG. 5A is a perspective view illustrating another aspect of a baffle apparatus and the bottom of a dispenser apparatus.
Figure 5B:
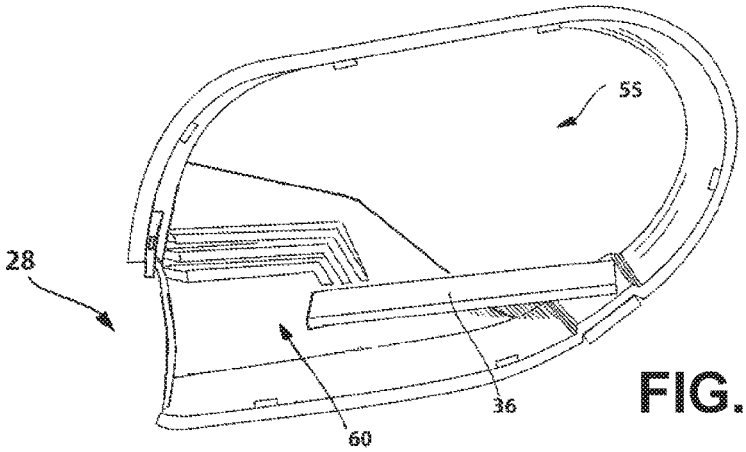
FIG. 5B is a perspective view illustrating another aspect of a barrier apparatus.
Figure 5C:
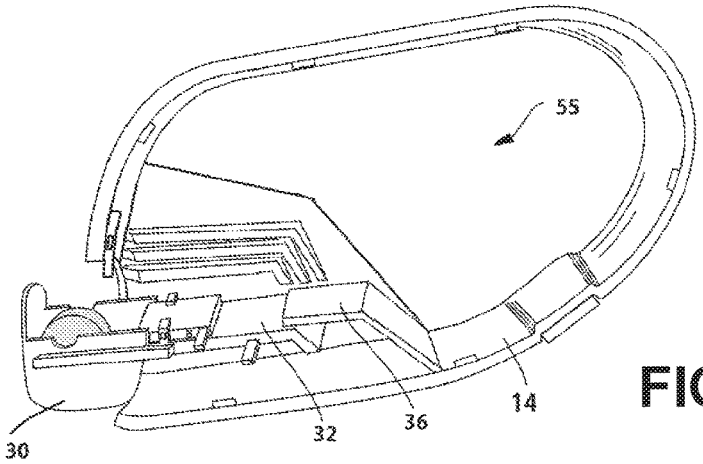
FIG. 5C is a perspective view illustrating still another aspect of the baffle apparatus and the barrier apparatus.

Turning to the alternative configuration of FIG. 5A, the baffle apparatus 32 may cooperate with a part of the bottom 14 to prevent the tablets and pills from falling into the gap formed when the delivering structure 10 moves to the dispensing position. In another aspect, as shown in FIG. 5B, the barrier apparatus 36 may extend toward the holder exit 28 and an opening 60 may be defined between the barrier apparatus 36 and the holder exit 28 and the extended barrier apparatus 36 may divide the housing 8 into an upper chamber for storage tablets or pills and a lower chamber for situating the delivering structure 10. In another aspect, as shown in FIG. 5C, the barrier apparatus 36 and the baffle apparatus 32 may slope down to the bottom 14 in order to enlarge the storage chamber 55.

Figure 13A:
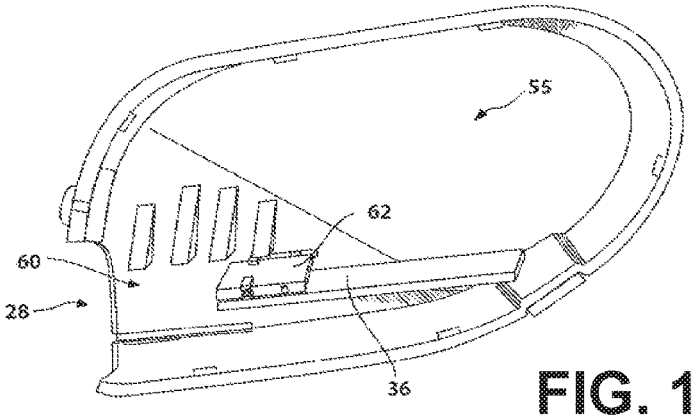
FIG. 13A is a perspective view of the left-half part of a dispenser apparatus illustrating an alternative aspect of the adjusting plate and the barrier apparatus.
Figure 13B:
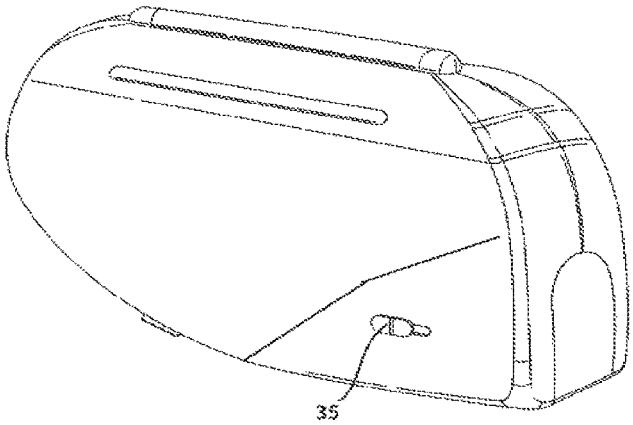
FIG. 13B is a perspective view of a dispenser apparatus employing the adjusting plate of FIG. 13A.

In another aspect, as shown in FIG. 13A, the barrier apparatus 36 may extend toward the holder exit 28, and the opening 60 may be defined between the barrier apparatus 36 and the holder exit 28. An adjusting plate 62 may be configured on the barrier apparatus 36 adjacent the opening 60, and a push button 35 (see FIG. 13B) may engage the adjusting plate 62 to permit sliding or reciprocating movement of the adjusting plate 62 to change the dimension of the opening 60 so as to permit different sizes tablets or pills to pass there through and into the carrying holder 30.

Figure 4A:
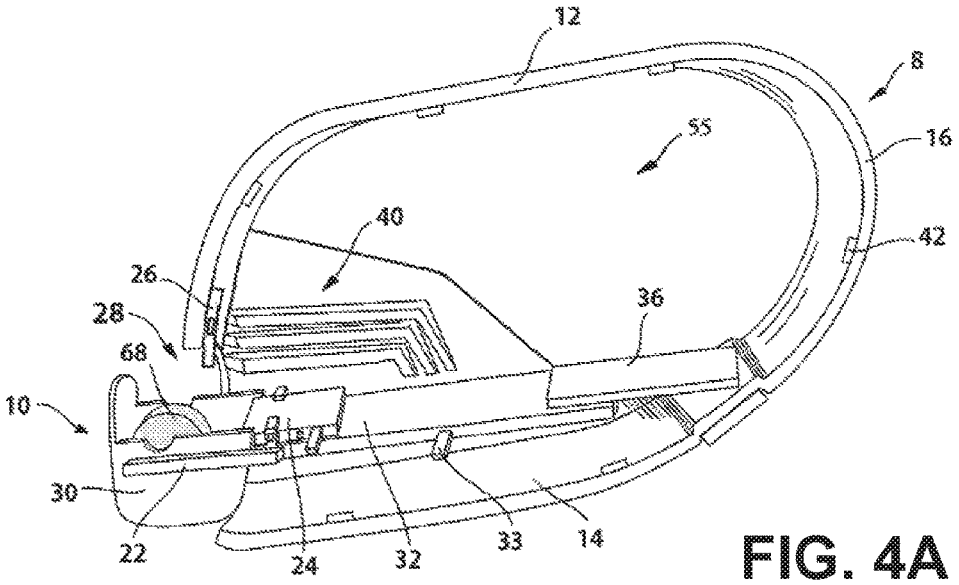
FIGS. 4A-4B are perspective views illustrating the inner side of left-half and right-half parts of the dispenser apparatus of FIG. 1.
Figure 4B:
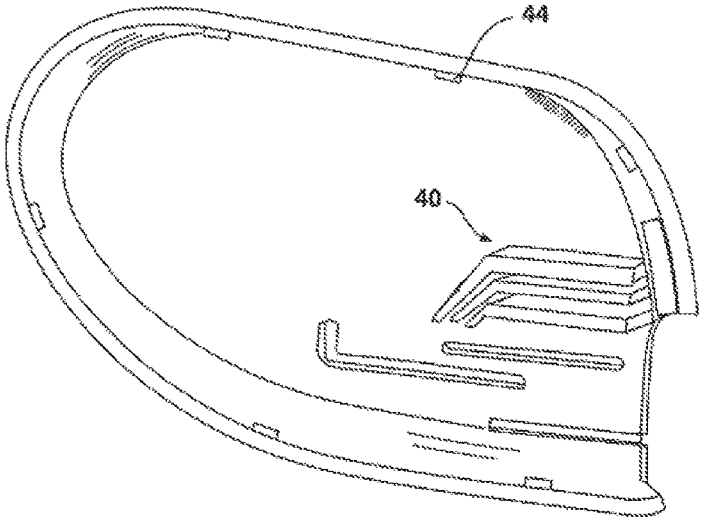
Figure 6A:
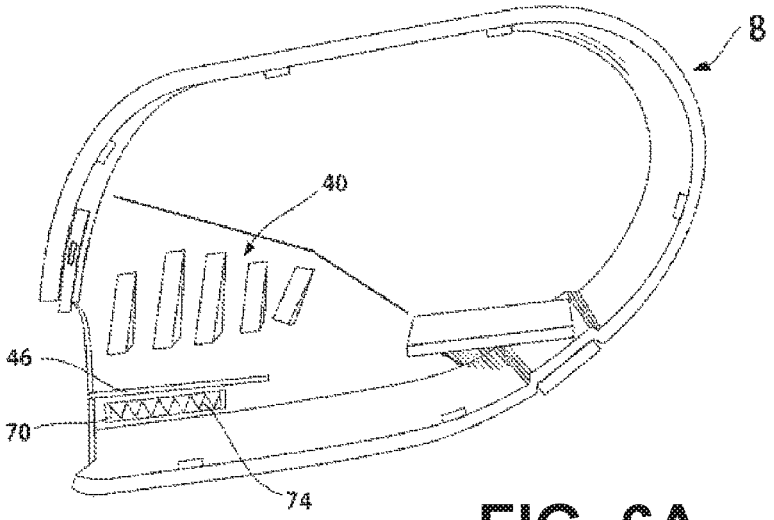
FIG. 6A-6B are perspective views of the inner side of left-half and right-half parts illustrating another aspect of a funnel apparatus.
Figure 6B:
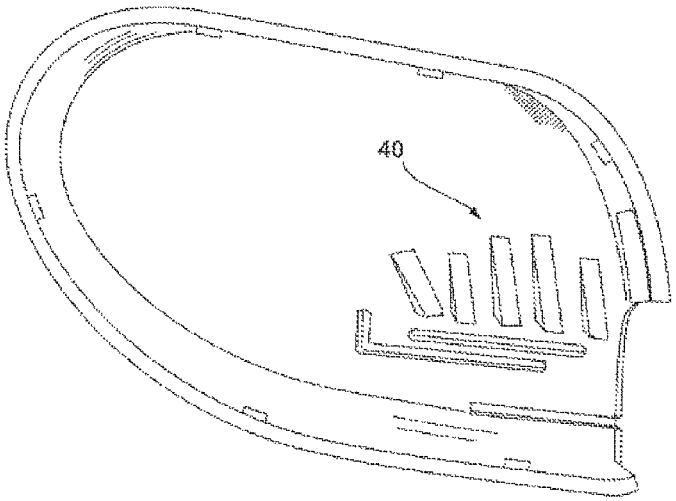
Figure 7A:
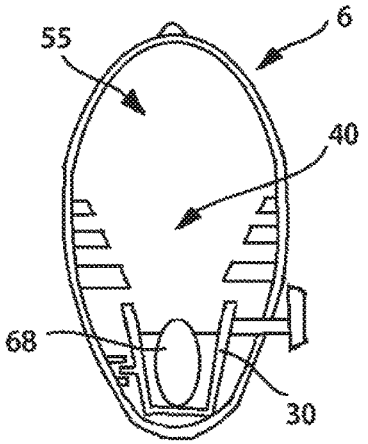
FIG. 7A is a simple cross-sectional view taken along line 7-7 of FIG. 2 illustrating an aspect of the funnel apparatus of the dispenser apparatus.
Figure 7B:
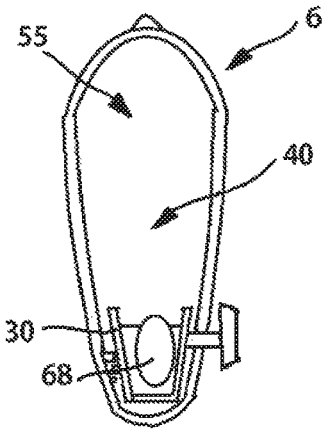
FIG. 7B is a simple cross-sectional view taken along line 7-7 of FIG. 2 illustrating the funnel apparatus formed by two sides of the dispenser apparatus.

As shown in FIGS. 4A and 4B, because the storage chamber 55 is configured between two sides of the housing 8, and the dimension between the two sides is bigger than the width of the carrying holder 30 (see FIG. 7A), the dispenser apparatus 6 may include a funnel apparatus 40 to facilitate rolling or other funneling of the tablets and pills from the storage chamber 55 into the carrying holder 30 when in the stowed configuration. It is within the teachings of the present disclosure that the funnel apparatus 40 may have any suitable configurations and manners for the intended functionality. For example, in one aspect, some transverse or obliquely vertical or slope bodies (see FIGS. 4A-4B) may be disposed on at least one side of the housing 8, such that the sides or edges of the bodies define the funnel apparatus 40 (see FIG. 7A) between the storage chamber 55 and the carrying holder 30. In another aspect, as shown in FIGS. 6A and B, the funnel apparatus 40 may be defined by other obliquely vertical or slope bodies, without the use of transverse bodies. In still another aspect, as shown in FIG. 7B, the curved, sloping two sides of the housing 8 may compose the funnel apparatus 40 between the storage chamber 55 and the carrying holder 30.

As shown in FIG. 4A, the adjusting plate 26 may be disposed proximate the holder exit 28 as in one of the ordinary manners in the art, and a button 52 (see FIG. 1) engages the adjusting plate 26 to change the dimension of the holder exit 28 in order to prevent different sizes of tablets or pills from rolling out of the holder exit 28 when a user operates the dispenser apparatus 6.

To assemble the housing 8, snap fit engaging members 42 and receiving ports 44 are provided on the two sides of the housing 8. The snap fit engaging members 42 may engage the receiving ports 44 to maintain the housing 8 in the closed position.

As shown in FIG. 6A, a spring groove 70 may be configured on one side of housing 8 and a coil spring 74 may be situated therein. The spring 74 may have a first end configured to couple to a spring hook 72 (see FIG. 9B) disposed on the delivering structure 10 and a second end coupled to or otherwise restrained within the housing 8 to facilitate the delivering structure 10 reciprocating motion.

Figure 8:
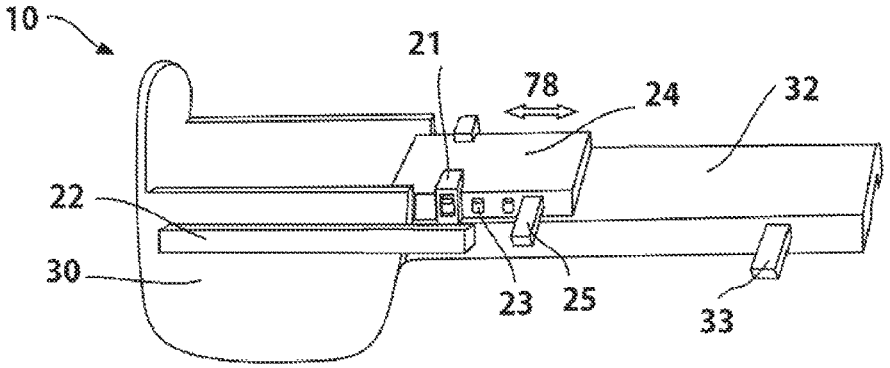
FIG. 8 is a detail perspective view illustrating the delivering structure.
Figure 12:
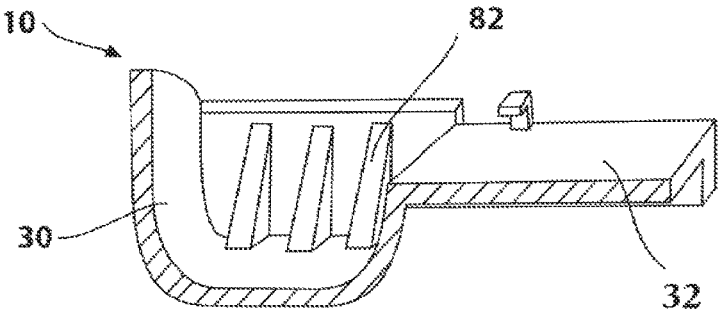
FIG. 12 is a cross-sectional view illustrating another aspect of the carrying holder of the delivering structure of FIG. 8.

FIG. 8 illustrates a close-up detailed view of the delivering structure 10. The delivering structure 10 may include the carrying holder 30, the extension 32, the guide rails 22, and the adjusting apparatus 24. The carrying holder 30 is used for holding and carrying the tablets or pills. In addition to the configuration provided in the figures, the carrying holder 30 alternatively may be configured as a non-lid box, a bucket or the like, etc. As shown in FIG. 12, the carrying holder 30 may include one or more sloping bodies 82 defined therein to facilitate dispensing or holding of the tablets or pills. The carrying holder 30 may be transparent so that the user can observe its condition. In one aspect, guide rails 22 may be configured on the delivering structure 10 to complement and interface with guide grooves 46 (see FIG. 6A) configured on the sides of the housing 8 to facilitate the delivering structure 10 reciprocation motion.

Figure 10A:
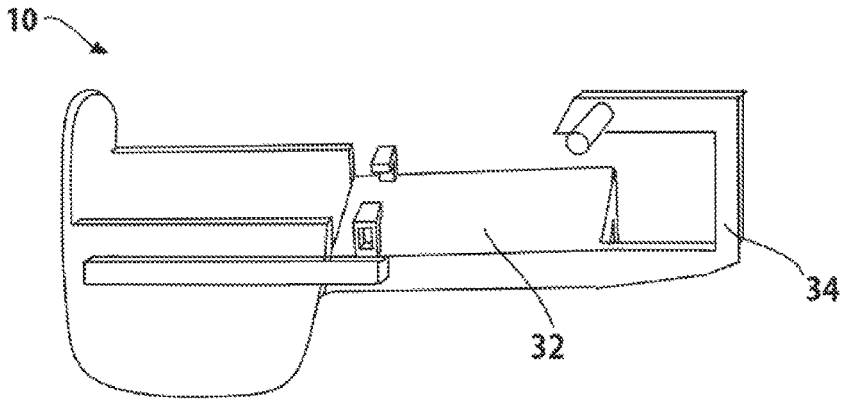
FIGS. 10A-10B are perspective views illustrating other aspects of the baffle apparatus of the delivering structure of FIG. 8.
Figure 10B:
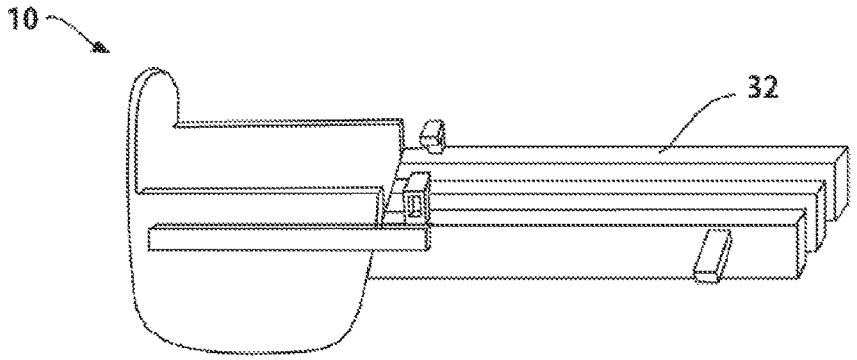

As shown in FIG. 8, the baffle apparatus 32 may be a piece of plate or other planar structure that connects to or is integrally formed with the rear of the carrying holder 30 in order to direct the tablets and pills of the storage chamber 55 toward the carrying holder 30. The baffle apparatus 32 also may serve to divide the housing 8 into an upper chamber and a low chamber, and to cooperate with the barrier apparatus 36 to prevent the tablets or pills 68 from falling into a gap defined when the dispensing structure is moved to the dispensing configuration (see FIG. 4). It is within the teaching of the present disclosure that the extension 32 may be formed of any suitable configurations and manners for the intended functionality. For example, in one aspect, as shown in FIG. 10B, the extension 32 may be formed by an array of perpendicular plates, using the edge of the plates to form a surface 32 to fulfil the intended functions. In another aspect, as shown in FIG. 10A, the baffle apparatus may have a long handle extension 34 to enhance comfort of a user operation. Moreover, catch portions 21 (see FIG. 8) fixed on the extension 32 are complementary to the protrusions 23 of the adjusting apparatus 24 to secure the adjusting apparatus 24 in one or more predetermined positions.

Figure 9A:
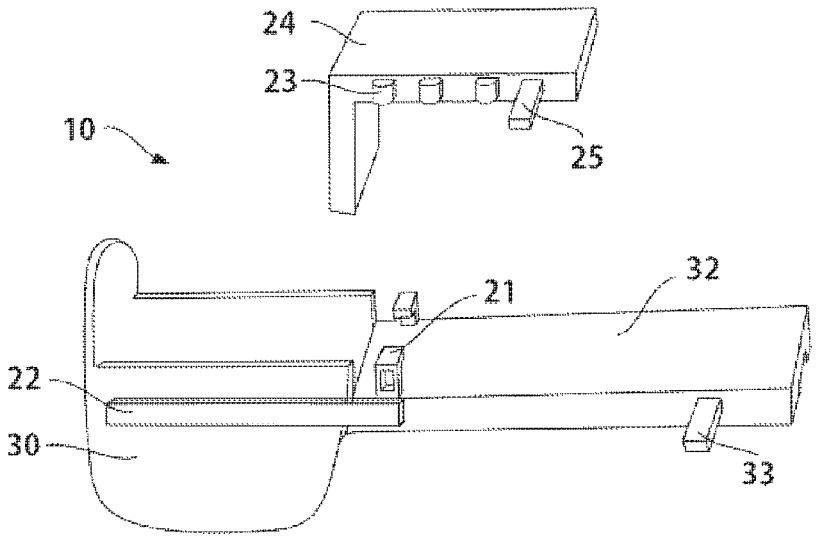
FIG. 9A is an exploded view of the delivering structure of FIG. 8.
Figure 9B:
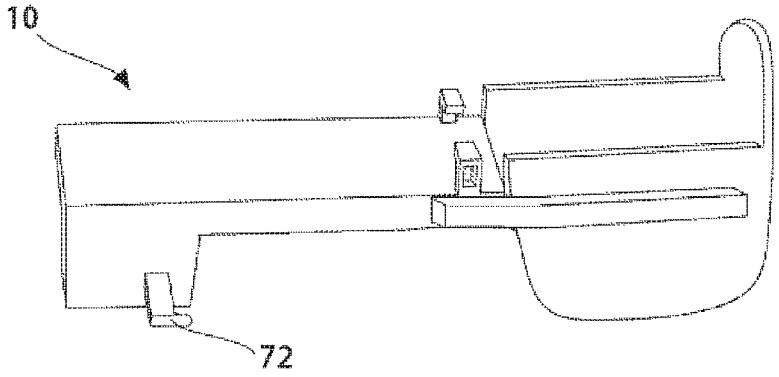
FIG. 9B is a perspective view illustrating the reserve side of the delivering structure of FIG. 8.

As shown in FIG. 9A, the adjusting apparatus 24 may be an L-shape plate. Part of the adjusting apparatus 24 may be situated on the baffle apparatus 32 and part of the adjusting apparatus 24 may be disposed within the carrying holder 30. The protrusions 23 attached on the adjusting apparatus 24 are complementary to the catch portions 21 of the baffle apparatus 32 so as to control the movement of the adjusting apparatus 24. A handle 25 may be fixed on the adjusting apparatus 24 and may couple to a button 56 to permit user adjustment of the adjusting apparatus 24 (see FIG. 1). When the dispenser apparatus 6 is in the stowed configuration, a user may firstly push the button 50 up to the lock position or hold the delivering structure 10 at the holder exit 28. The user may then push the button 56 (see FIG. 2) to engage the adjusting apparatus 24 (see FIG. 8) so as to change the inside dimension of the carrying holder 30 for holding the desired sizes or pieces of tablets or pills.

Figure 11A:
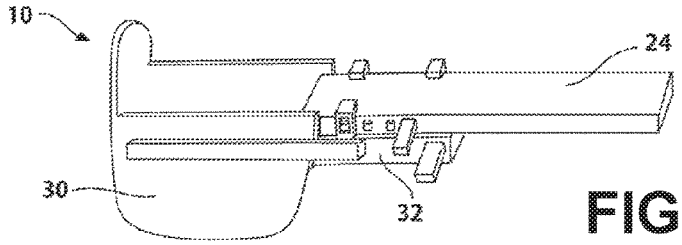
FIGS. 11A-11C are perspective views illustrating other aspects of the adjusting apparatus of the delivering structure of FIG. 8.
Figure 11B:
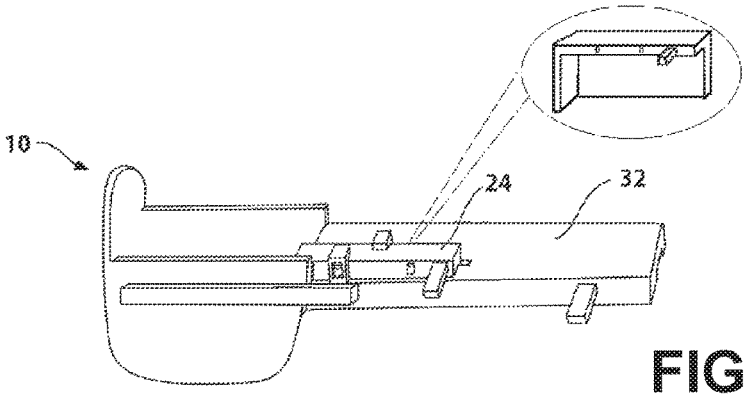
Figure 11C:
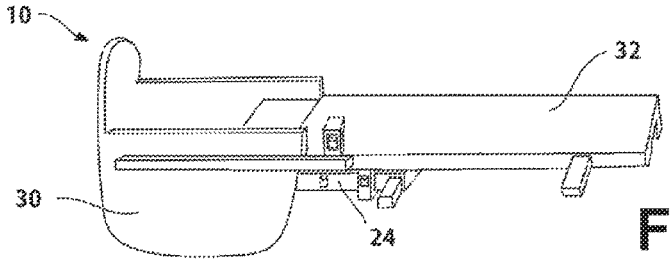

It will be recognized by those of skill in the art that the adjusting apparatus 24 may be formed by any suitable configuration or manner to provide intended functionality for changing the inside dimension of the carrying holder 30. For example, as shown in FIG. 11A, the baffle apparatus 32 may be short and the adjusting apparatus 24 may have a long extension. In another aspect, as shown in FIG. 11B, the adjusting apparatus 24 may be a narrow, long L-shape plate to change the width dimension of the carrying holder 30. In another aspect, as shown in FIG. 11C, the adjusting apparatus 24 may be disposed below the baffle apparatus 32.

Figure 14:
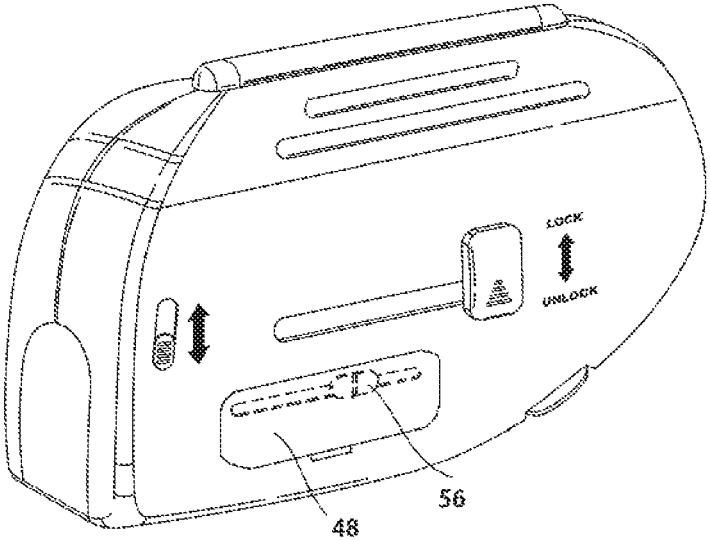
FIG. 14 is a perspective view illustrating an aspect of the dispenser apparatus with a cover disposed on a push button of the adjusting apparatus.

As shown in FIG. 14, a cover 48 may be disposed on the housing 8 to cover and hide the button 56 of the adjusting apparatus 24.

It should be recognized from the preceding disclosure that the dispenser apparatus 6 can dispense desired sizes or pieces of tablets or pills and that the user can change the dimension of the holder exit 28, the carrying holder 30 and the opening 60 respectively or cooperatively to tailor that dispensing to a desired numbers or sizes of tablets or pills.

While the preceding detailed description references several examples and aspects, it will be understood that one of ordinary skill in the relevant art will be able to make various modification and changes to the described aspects without departing from the true spirit and scope thereof. It is also be understood if all elements or steps which are insubstantially different from the art in the claims but fulfill the substantially same functions, respectively, in substantially the same way to acquire the same result as what is claimed are within the scope of the disclosure.

What is claimed is:

1. An apparatus configured to dispense desired size or desired pieces of items, the apparatus comprising:

a container comprising a storage chamber and a rest chamber;

a delivery member comprising a carrying holder and a holder adjusting apparatus;

wherein the holder adjusting apparatus is configured to adjust at least one dimension of the carrying holder so that the carrying holder carries desired size or desired pieces of the items;

wherein the delivery member is configured to move in a reciprocating motion between a stowed configuration and a dispensing configuration, wherein in the stowed configuration, the delivery member is located in the rest chamber of the container; and a first push button configured to engage the delivery member in the reciprocating motion, the first push button comprising a detent, wherein in the stowed configuration, engagement of the detent of the push button locks the delivery member in order to prevent unintended motion of the delivery member, wherein in the stowed configuration, the detent of the first push button is configured to lock the delivery member and a second push button is configured to engage the holder adjusting apparatus to change at least one dimension of the carrying holder in order to carry desired size or desired pieces of the items.

2. The dispenser apparatus of claim 1, wherein the container is configured in the shape of an animal or a cartoon profile.

3. The dispensing apparatus of claim 1, wherein the holder adjusting apparatus is an L shape board, and wherein a handle facilitates the L shape board to change at least one dimension of the carrying holder for carrying desired size or desired pieces of the items.

4. The dispensing apparatus of claim 1, further comprising a spring having a first end coupled to the container and a second end coupled to the carrying holder, the spring being configured to cause the carrying holder to return automatically from the dispensing configuration to the stowed configuration.

5. The dispensing apparatus of claim 1, wherein a size and a shape of the carrying holder are configured to accommodate at least one item stored in the storage chamber.

6. The dispensing apparatus of claim 1, wherein the items comprise one or more pieces of candy, pieces of chewing gum, tablets, or pills.

7. The dispensing apparatus of claim 1, wherein in the stowed configuration, the items in the storage chamber are configured to move through a funnel apparatus into the carrying holder of the delivery member, and wherein the first push button pushes the delivery member to the dispensing configuration for dispensing the items.

8. The dispensing apparatus of claim 7, wherein the funnel apparatus comprises transverse, obliquely vertical, or slope bodies that are arranged on at least one of the first side and the second side of the container, or wherein the funnel apparatus comprises at least one of a curved first side of the container and a curved second side of the container.

9. The dispenser apparatus of claim 7, further comprising a first cover hingedly coupled to the storage chamber, wherein opening the first cover allows for refilling the items into the storage chamber, and wherein a second cover covers the second push button of the holder adjusting apparatus.

10. An apparatus configured to dispense items, the apparatus comprising, a container comprising:

a first side, a second side, a storage chamber, and a rest chamber, wherein the storage chamber and the rest chamber are formed between the first side and the second side and span an area between the first side and the second side;

a delivery member comprising:

a carrying holder, a holder adjusting apparatus, and a baffle apparatus, wherein the delivery member is configured to be positioned in the rest chamber in a stowed configuration;

a holder exit disposed on a sidewall of the container, the delivery member being configured to move in a reciprocating motion through the holder exit between the stowed configuration and a dispensing configuration;

a handle configured to engage the holder adjusting apparatus to change at least one dimension of the carrying holder so that the carrying holder carries a desired size or a desired piece of the items;

a first push button configured to engage the delivery member, wherein in the stowed configuration, a detent of the first push button locks the delivery member in order to prevent unintended motion of the delivery member;

a funnel apparatus spanning between the first side and the second side of the container;

a barrier apparatus spanning between the first side and the second side of the container, wherein a combination of the funnel apparatus and the barrier apparatus or a combination of the funnel apparatus, the barrier apparatus, and a portion of the baffle apparatus of the delivery member defines a boundary between the storage chamber and the rest chamber and extends from the holder exit to a bottom of the container or from the holder exit to an opposite sidewall and over the carrying holder and the handle, and a first cover hingedly coupled to a the storage chamber, wherein opening the first cover allows for refilling the items into the storage chamber, wherein a second cover covers a second push button of the holder adjusting apparatus.

11. The dispensing container of claim 10, wherein the barrier apparatus comprises a plate or a plurality of beams.

12. The dispensing apparatus of claim 10, wherein the funnel apparatus comprises transverse, obliquely vertical, or slope bodies arranged on at least one of the first side or the second side of container, or wherein the funnel apparatus comprises at least one of a curved first side and a curved second side of the container.

13. The dispensing apparatus of claim 10, wherein the container is configured in the shape of an animal or a cartoon profile.

14. The dispensing apparatus of claim 10, wherein the items comprise one or more pieces of candy, pieces of chewing gum, tablets, or pills.

15. The dispensing apparatus of claim 10, further comprising a spring having a first end coupled to the container and a second end coupled to the carrying holder, the spring being configured to cause the carrying holder to return automatically from the dispensing configuration to the stowed configuration.

16. The dispenser apparatus of claim 10, wherein an exterior force pushes the first push button upward to the detent to lock the delivery member.

17. The dispensing apparatus of claim 10, wherein a corner of the container above the holder exit is curved, cut, or round and is configured to prevent the dispensing apparatus hitting a user's mouth during operation.

18. An apparatus configured to dispense items, the apparatus comprising:

a container comprising a sidewall;

a holder exit disposed on the sidewall of the container;

a delivery member comprising a carrying holder and a holder adjusting apparatus, wherein the delivery member is configured to move in a reciprocating motion through the holder exit between a stowed configuration and a dispensing configuration;

an exit adjusting apparatus disposed on the holder exit, the exit adjusting apparatus being configured to change at least one dimension of the holder exit; and a handle configured to engage the holder adjusting apparatus to change at least one dimension of the carrying holder so that the carrying holder carries a desired size or a desired piece of the items, wherein the holder adjusting apparatus and the exit adjusting apparatus work cooperatively for dispensing a desired size of the items stored by the container.

19. The dispensing apparatus of claim 18, wherein in the stowed configuration, the items in a storage chamber are configured to move through a funnel apparatus into the carrying holder of the delivery member, and wherein a first push button pushes the delivery member to the dispensing configuration for dispensing the items.

20. The dispensing apparatus of claim 18, wherein the holder adjusting apparatus is an L shape board, and wherein the handle facilitates the L shape board to change the at least one dimension of the carrying holder for carrying desired size or desired pieces of the items.

21. The dispensing apparatus of claim 18, wherein a size and a shape of the carrying holder are configured to accommodate at least one item stored in a storage chamber.

22. The dispensing apparatus of claim 18, wherein the items comprise one or more pieces of candy, pieces of chewing gum, tablets, or pills.

23. The dispenser apparatus of claim 18, further comprising a first cover hingedly coupled to a storage chamber, wherein opening the first cover allows for refilling the items into the storage chamber, and wherein a second cover hingedly covers a second push button of the holder adjusting apparatus.

24. The dispenser apparatus of claim 18, wherein a third push button engages the exit adjusting apparatus to adjust the at least one dimension of the holder exit.

25. An apparatus configured to dispense items, the apparatus comprising, a container comprising:

a first side, a second side, a storage chamber, and a rest chamber, wherein the storage chamber and the rest chamber are formed between the first side and the second side and span an area between the first side and the second side; and a delivery member configured to be positioned in the rest chamber in a stowed configuration, and configured to move in a reciprocating motion between the stowed configuration and a dispensing configuration;

a funnel apparatus adjacent to a barrier apparatus spanning between the first side and the second side of the container; and an adjusting device on the barrier apparatus configured to adjust at least one dimension of the funnel apparatus in order to allow a desired size of the items to move through the funnel apparatus into a carrying holder of the delivery member, wherein a combination of the funnel apparatus and the barrier apparatus or a combination of the funnel apparatus, the barrier apparatus, and a portion of a baffle apparatus of the delivery member defines a boundary between the storage chamber and the rest chamber, wherein the boundary extends from a holder exit to a bottom of the container or from the holder exit to an opposite sidewall and over the carrying holder and a handle, and wherein a second push button is configured to engage the adjusting device to adjust the at least one dimension of the funnel apparatus.

26. The dispensing apparatus of claim 25, wherein in the stowed configuration, the items in the storage chamber are configured to move through the funnel apparatus into the carrying holder of the delivery member, and wherein a first push button is configured to push the delivery member to the dispensing configuration for dispensing the items.

27. The dispensing apparatus of claim 25, further comprising a holder adjusting apparatus comprising an L shape board, and wherein the handle facilitates the L shape board to change at least one dimension of the carrying holder for carrying desired size or desired pieces of the items.

28. The dispensing apparatus of claim 25, wherein a size and a shape of the carrying holder are configured to accommodate at least one item stored in the storage chamber.

* * * * *